US005873846A

United States Patent [19]

Meilus

[11] Patent Number: 5,873,846

[45] Date of Patent: Feb. 23, 1999

[54] APPARATUS FOR LENGTHENING NECK MUSCLES AND METHOD OF USE

[76] Inventor: Algis A. Meilus, 331 N. Tessier Dr., St. Petersburg Beach, Fla. 33706

[21] Appl. No.: 827,969

[22] Filed: Apr. 14, 1997

[51] Int. Cl.[6] ..... A61H 1/02

[52] U.S. Cl. ..... 601/39; 482/10; 601/134; 5/636

[58] Field of Search ..... 482/10, 131, 139; 601/23, 39, 134, 135; 606/204, 204.15, 240; 600/553, 557; 128/845, 869, 870, 907; 5/622, 636, 637, 643

[56] References Cited

U.S. PATENT DOCUMENTS

| | | | |
|---|---|---|---|
| 1,746,080 | 2/1930 | Hamilton | 606/240 |
| 4,114,612 | 9/1978 | Benjamin . | |
| 4,494,261 | 1/1985 | Morrow | 5/636 |
| 5,024,215 | 6/1991 | Wang | 482/131 |
| 5,070,865 | 12/1991 | Iams | 606/240 |
| 5,467,490 | 11/1995 | Rice | 5/636 |
| 5,491,855 | 2/1996 | Charles | 5/636 |
| 5,575,295 | 11/1996 | Khalsa et al. | 5/636 |

*Primary Examiner*—Jeanne M. Clark
*Attorney, Agent, or Firm*—Dorothy S. Morse

[57] ABSTRACT

A neck treatment apparatus for patient self-treatment, and a method for its use, with which a patient can apply repeated amounts of deep concentrated pressure to muscles in the area between the base of the skull and the first vertebra to lengthen the muscles therein and provide the patient with relief from tension and pain. The apparatus is compact in design, made from lightweight easy-to-clean materials, and comprises a single treatment member upwardly depending from the center portion of the upper surface of a base support. In the preferred embodiment the treatment member has a width dimension of approximately six inches, a thickness dimension of approximately one-half of an inch, and a height dimension of approximately four inches. In transverse cross-section, the top of the preferred embodiment of the treatment member tapers to a point to act as a wedge, having the configuration of an equilateral triangle with side dimensions each measuring approximately one-half of an inch. The treatment member also has a cut-out in its upper edge, in the form of a V-shaped notch, which in the preferred embodiment has a depth dimension of approximately one-half of an inch and a width dimension of approximately one-half of an inch. During use, the area of a patient between base of the skull and the first vertebra is centrally placed over the V-shaped notch for a maximum time period of approximately ten minutes to lengthen the muscles therein and relieve excess muscular tension and pain.

12 Claims, 1 Drawing Sheet

APPARATUS FOR LENGTHENING NECK MUSCLES AND METHOD OF USE

BACKGROUND—FIELD OF INVENTION

This invention relates to neck muscle treatment devices, specifically to a compact and easy-to-use neck muscle treatment apparatus designed for patient self-treatment and which involves the application of uncomfortable deep pressure to muscles in the area between the uppermost neck vertebra and the base of the skull to cause contacted muscles therein to lengthen and thereby provide treated patients with relief from excess muscular tension and pain.

BACKGROUND—DESCRIPTION OF PRIOR ART

People commonly experience musculoskeletal pain and muscular tension, the source of which can be related to sports activities, other strenuous physical activity, accidents, poor posture, medical conditions, as well as other causes. Such pain is routinely treated by a variety of procedures which include the use of anti-inflammatory drugs, narcotic medications, thermal devices to raise or lower the temperature of affected tissues, electric stimulation, ultrasound, physical therapy, and massage therapy. However, while use of these treatment procedures can be effective for the temporary relief of adverse symptoms and limited mobility related thereto, they are usually not effective in relieving the cause of the symptoms. Also, the drugs and medications can induce adverse side affects in patients.

Muscular therapy is an alternative to the above-mentioned treatments in relieving musculoskeletal pain and excess muscle tension. Unlike massage therapy which treats the muscle itself superficially, or physical therapy which works to strengthen weak spots, muscular therapy is the practice of repeatedly applying uncomfortable levels of concentrated pressure to a muscle to release therefrom the build-up of lactic acid and other metabolic by-products resulting from strenuous exercise, spasm, and/or tension. Upon such release, normal blood flow is restored to a muscle, diminishing pain and tension. As pressure is applied gradually and specifically to the point of spasm, sometimes the size of a small pea, three changes occur. First the muscle tissue lengthens, which is observable under a microscope. Second, the electrical activity of the nerve that innervates the area is reduced, a change which is measurable by EMG units, such as those typically used for biofeedback. Third, three acids are released, lactic acid, carbonic acid, and hyaluronic acid which result in the sting and discomfort felt by the patient during the application of the pressure. As this therapeutic process continues, the muscle tissues soften, the discomfort diminishes, and when all of the acid is removed from the muscle, one hundred pounds or more of pressure can usually be applied to the muscle with no discomfort.

Muscular therapy takes an engineering approach to treating the body by viewing it as a series of cables and fulcrums. By identifying the muscles operating different fulcrums during a repeated activity, diagnosis and treatment of pain and limited mobility caused by the repeated activity can be provided through the use of physics and the repetitive application of uncomfortable levels of concentrated pressure to specific muscles one-at-a-time to lengthen them so that associated joints can move with less restriction. Relief provided by muscular therapy is often immediate, allowing the quick resumption of activity. Preventative muscular therapy and self-treatment can prevent problems from recurring. Also, with continued muscular therapy, muscles have a faster response time, greater stamina, more leverage, and increased power and accuracy. Further, people with a skewed center of gravity, both disease-related and that due to poor posture, can achieve better balance through muscular therapy. In addition, repetitive application of pressure to injured tissue, in addition to relieving pain and enhancing blood circulation, desensitizes it and helps to speed the maturation of scars.

Traditionally, muscular therapy treatments have been performed manually by therapists using their fingers, hands, elbows, and the like. Similar procedures involve cranial-sacral therapy wherein a therapist's hands have been used to separate a space between the base of the skull and the first vertebra so that the dural tube covering the spinal column can be stretched and tractioned from the base of the skull to the sacrum. Muscular therapy is physically demanding on a therapist since in performing certain treatment procedures, such as when they try to loosen back muscles, muscular therapists are required to apply pressures which sometimes exceed sixty pounds of pressure. As a work day progresses and the therapist tires, treatments given by a muscular therapist may not be uniform. In treating the muscles between base of the skull and the first vertebra a muscular therapist must place his or her hands adjacent to one another on a flat surface with the palms up, then with fingers bent upward approximately ninety degrees relative to the palms, the area between the patient's skull and the first vertebra would be placed upon the collective fingertips of the muscular therapist. When treatments have a duration approaching ten minutes, the fingers of a muscular therapist can become stressed. As a result muscular therapists may have to limit the amount of time they manually perform such tissue manipulation. Also, the position of the fingertips required for treatment of the neck muscles between the base of the skull and the first vertebra makes it impossible for a person to treat themselves with their own hands. The present invention is designed specifically for self-treatment by patients so that they can apply deep, concentrated pressure to the muscles between the base of their skull and their first vertebra, and duplicate the type of pressure applied manually by muscular therapists to such muscles. The device does not tire during a day's work and can apply uniform pressures. While it is known to have massage therapy neck devices which support the sides of a patient's neck and apply soothing, superficial pressure to muscles in a patient's neck area, or support the skull while a patient rolls his or her head on the support to stretch muscles in the patient's neck, it is not known to have a neck treatment apparatus which has a thin upper edge designed to concentrate pressure uncomfortably against the muscles deeply positioned between base of the skull and the first vertebra of a patient, with a centrally located V-shaped notch in its upper edge that approximates the configuration of the space created on the upper surface of muscular therapist's collective fingertips by the therapist's two adjacent shorter fourth fingers, so that the apparatus can be used to closely duplicate manual muscular therapy treatment procedures wherein a muscular therapist applies repeated amounts of deep, concentrated pressure by use of his or her collective fingertips to the muscles between the skull and the first cervical vertebra for periods of time approaching ten minutes to cause muscles in the treated area, as well as muscles associated with the treated muscles, to lengthen and thereby provide the patient with relief from excess muscular tension and pain.

The prior art thought to be the closest in function to the present invention is the invention disclosed in U.S Pat. No. 4,114,612 to Benjamin (1978). The Benjamin invention comprises two triangular-shaped end caps with three elongated members positioned therebetween. Each elongated member has a longitudinal arcuate free edge which projects at a 120° angle relative to the next adjacent elongated member. Thus, when positioned between the end caps, the collective elongated members form a device having three arcuate free edges and the cross-sectional configuration of an equilateral triangle which allows for upward positioning of one of the arcuate free edges at a time for muscular tension treatment. Also, in the preferred embodiment of the Benjamin tension releasing device, each of the three arcuate free edges has a different diameter dimension for application of an amount of concentrated pressure distinct from that provided by the other two arcuate free edges, with the arcuate free edge having the smallest diameter being able to apply the most concentrated pressure.

In column 3, lines 62–68, of the Benjamin disclosure it is stated that the Benjamin invention should be used in the occiput area of the head, where the skull meets the neck. The arcuate free edge with the largest diameter is first placed in a position to support the upper occipital line. In column 4, lines 7–17, discussion of use continues by stating that a user would then roll his or her head from side to side while the occiput is so supported. When a sore point is found, the user would remain in that position for ten to fifteen seconds, then continue the rolling motion until all painful points have been found and treated. The arcuate free edge would then be used to support the lower occipital line while the user repeats the rolling motion, after which support of the upper occipital line is repeated. Following use of the arcuate free edge having the largest diameter, a user can then employ the other two arcuate free edges in the same manner to apply more concentrated pressures, if needed.

Although the Benjamin invention can effectively be used to release tension in muscle tissue near the attachment point of muscles to the skull, there are many layers of muscles deep within the area between the base of the skull and the first neck vertebra which the Benjamin invention is not designed to reach. As the Benjamin disclosure discusses in column 1, lines 25–43, it is used to very firmly apply pressure at the occiput at the point of attachment of muscles to the bone where the greatest amount of tension is frequently found during muscle contraction. However, not all tension is found there, and some results from points of spasm in muscles deep within the area between the uppermost neck vertebra and the base of the skull. The elongated members depending from the sides of each arcuate free edge in the Benjamin invention are essentially rigid and planar, and thus continually diverge from one another at a 120° angle until the distance between their distal ends is at least three or four inches. Such a configuration would not allow effective penetration of the upwardly protruding arcuate free edge of the Benjamin invention between the base of the skull and the first neck vertebra for muscular lengthening of the deepest muscle tissue underlying the multiple layers of muscle found in this area of a patient's neck. In contrast, the present invention is designed with a thin profile, preferably not more than one-half of an inch in width, which allows it penetrate sufficiently deep between the base of the skull and the first cervical vertebra to cause muscles positioned under several other layers of muscle to lengthen. Further, the present invention has a centrally located V-shaped notch which allows its upper edge to reach past the spinous processus of the first cervical vertebra during initial stages of treatment when muscles between the base of the skull and the first cervical vertebra are shortened and reduce the space therebetween into which the present invention can be inserted to begin application of pressure. Thus the V-shaped notch allows the present invention to provide to a user with tension relief in the muscles between the base of the skull and the uppermost neck vertebra that is faster than that provided by the Benjamin invention.

SUMMARY OF INVENTION

OBJECTS AND ADVANTAGES

It is the primary object of this invention to provide a neck treatment apparatus which simulates the deep concentrated pressure applied to patient muscles between the base of the skull and the first vertebra during fingertip treatments given manually by muscular therapists. It is also an object of this invention to provide a neck treatment apparatus for use in self-treatment by patients to relieve pain and tension resulting from contracted muscles within the area between base of the skull and the first vertebra, as well as associated muscles affected by contraction of the treated neck muscles. It is a further object of this invention to provide a neck treatment apparatus which is compact in configuration, made of lightweight materials, and easy-to-use. A further object of this invention is to provide a neck treatment apparatus that is made from materials that can be easily cleaned.

As described herein, properly manufactured and used, the present invention would provide a neck treatment apparatus having a base support and a single treatment member upwardly depending from the central portion of the base support's upper surface. The treatment member has a thinly profiled configuration with a sharp upper edge to simulate treatments provided by a muscular therapist's upwardly depending fingertips when they are placed between the base of the skull of a patient and his or her first vertebra to provide sufficient deep pressure to lengthen muscles positioned under other muscles within the targeted neck area, and thereby relieve pain and tension in the patient The apparatus is compact in design and made from lightweight, easy-to-clean materials. In the preferred embodiment the treatment member has a maximum width dimension of approximately six inches, a thickness dimension of approximately one-half of an inch, and a height dimension of approximately four inches. When viewed transversely, the top of the treatment member, which functions as a wedge, is seen to taper to a point and has the configuration of an equilateral triangle with each side approximately one-half of an inch in length. The treatment member also has a central cut-out portion in its upper edge, in the form of a V-shaped notch, which has a depth of approximately one-half of an inch and a width of approximately one-half of an inch. During use, the area between base of the skull and the first vertebra of a patient is centrally placed over the V-shaped notch for a maximum time period of approximately ten minutes, during which the muscles therein are lengthened and tension and pain in the patient is relieved.

The description herein provides preferred embodiments of the present invention but should not be construed as limiting the scope of the muscular therapy invention. For example, variations in the type of material from which the base support is made as long as the material is sufficiently rigid and easily cleaned, the type of material from which the upwardly depending treatment member is made, the thickness of the base support, and the process by which the base support and the treatment member are joined, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
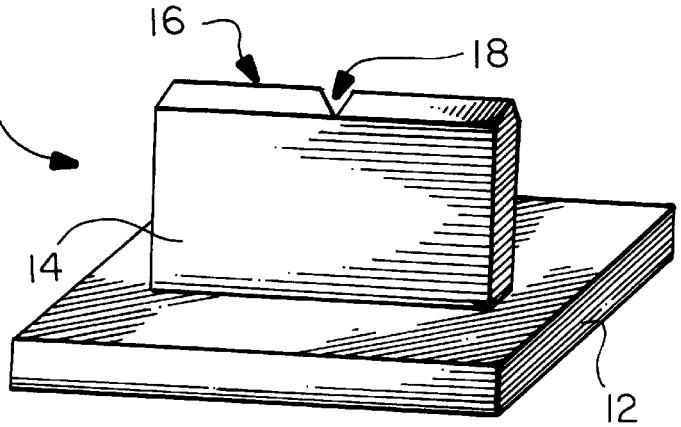
FIG. 1 is a perspective view of the invention having a base support and a single treatment member upwardly and centrally depending therefrom.

FIG. 1 shows a preferred embodiment of a neck treatment apparatus 10 having a planar base support 12 and an essentially planar treatment member 14 upwardly depending therefrom. FIG. 1 shows the bottom portion of treatment member 14 centrally positioned upon the upper surface of base support 12. The means of attachment of treatment member 14 to base support 12 is not critical, however, in the preferred embodiment it is contemplated for treatment member 14 and base support 12 to be made as a one-piece unit by molded construction. Also, the materials from which treatment member 14 and base support 12 are made are not critical to the present invention, as long as treatment member 14 and base support 12 are sufficiently rigid to support the base of a skull of a patient, shown in FIG. 2 as number 20, and they can be easily cleaned. Although not critical, it is also contemplated for base support 12 to have rounded corners for enhanced patient safety. Although FIG. 1 shows base support 12 having a rectangular configuration, such a configuration is not critical to neck treatment apparatus 10. However, in the preferred embodiment base support 12 has a square configuration with each side of the square perimeter having a length dimension between eight and ten inches.

FIG. 1 also shows treatment member 14 having an upper edge 16 which when viewed from the side of treatment member 14 is seen to taper to a point. FIG. 1 further shows treatment member 14 having a cut-out in its upper surface in the form of a V-shaped notch 18 sufficient in size to prevent pressure from being applied to the spinous processus of the first vertebra, shown in FIG. 2 as number 22, during initial stages of treatment when muscles are shortened due to contraction and when upper edge 16 would not otherwise be able to sufficiently penetrate the area between skull 20 and first vertebra 22 to contact deep muscles (not shown) therein and apply the amount of deep concentrated pressure needed to lengthen them. Although the dimensions are not critical, in the preferred embodiment of the present invention it is contemplated for V-shaped notch 18 to have a depth of approximately one-half of an inch and a minimum width of approximately one-half of an inch. When the preferred embodiment of treatment member 14 is viewed transversely, the top of the preferred embodiment of the treatment member is shown to function as a wedge since it tapers to a point, and to also have the configuration of an equilateral triangle with sides which are each approximately one-half of an inch in length. Thus, in the preferred embodiment of the present invention it is contemplated for the angle between the tapering sides of the upper edge of treatment member 14 to be approximately 120°. In the preferred embodiment of neck treatment apparatus 10 it is contemplated for treatment member 14 to have a maximum width dimension of approximately six inches, a thickness dimension of approximately one-half of an inch, and a height dimension of approximately four inches.

Figure 2:
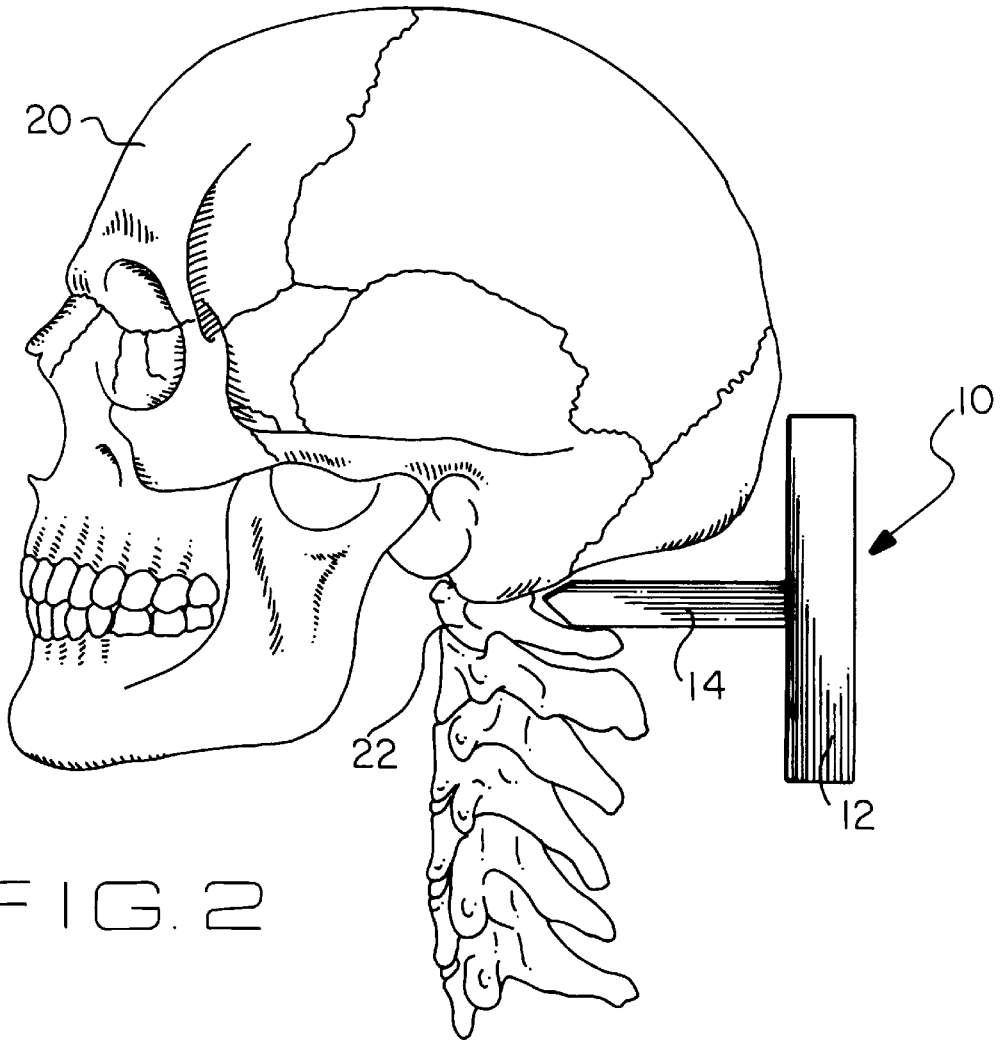
FIG. 2 is a side view of the invention positioned after it has successfully lengthened deep muscles between the base of the skull and the first vertebra adjacent thereto.

During use, base support 12 is placed on a flat surface and the area between the base of skull 20 and first vertebra 22 of a patient is centrally placed over V-shaped notch 18 for a maximum time period of approximately ten minutes to lengthen the muscles therein and relieve tension and pain in the patient. FIG. 2 shows neck treatment apparatus 10 positioned after it has successfully lengthened deep muscles between the base of skull 20 and first vertebra 22, with base support 12 adjacent to the base of skull 20 and the distal end of treatment member positioned deep within the area between the base of skull 20 and first vertebra 22.

I claim:

1. A neck treatment apparatus for use by a patient for self-treatment in applying deep concentrated pressure to muscles in the area between the base of the skull and the first vertebra of the patient so as to simulate application of deep pressure in treatments given manually by the collective fingertips of muscular therapists to lengthen the muscles therein and thereby relieve excess muscular tension and pain in the patient, wherein said apparatus comprises a planar base support made of rigid materials and having an upper surface with a central portion and an essentially planar treatment member also made from rigid materials upwardly depending from said central portion, said treatment member having an upper portion with an upper edge tapering to a point, said upper edge also having a central cutout therein in the shape of a V-shaped notch with a minimum depth dimension of approximately one-half inch and a minimum width dimension of approximately one-half inch; wherein said upper edge has opposing sides being connected one to the other to form a maximum angle of 120° and wherein said upper portion is configured as an equilateral triangle having three sides each approximately one-half inches in length so that said upper portion can function as a wedge.

2. The apparatus of claim 1 wherein said base support and said treatment member are made from rigid, lightweight plastic materials.

3. The apparatus of claim 2 wherein said base support and said treatment member are made as a one-piece unit from molded construction.

4. The apparatus of claim 3 wherein said base support has a square configuration with a minimum side dimension of eight inches and a maximum side dimension of ten inches.

5. The apparatus of claim 4 wherein said treatment member has a length dimension of approximately six inches, a thickness dimension of approximately one-half of an inch, and a height dimension of approximately four inches.

6. A neck treatment apparatus for use by a patient for self-treatment in applying deep concentrated pressure to muscles in the area between the base of the skull and the first vertebra of the patient so as to simulate application of deep pressure in treatments given manually by the collective fingertips of muscular therapists to lengthen the muscles therein and thereby relieve tension and pain in the patient, wherein said apparatus comprises a planar base support made of rigid materials and having an upper surface with a central portion; and an essentially planar treatment member upwardly depending from said central portion, said treatment member having a length dimension of approximately six inches, a thickness dimension of approximately one-half of an inch, and a height dimension of approximately four inches, said treatment member also having an upper portion with opposing sides tapering upwardly to a point, said opposing sides being connected one to the other to form a maximum angle of 120°, said upper portion being configured as an equilateral triangle having three sides each approximately one-half inches in length so that said upper portion can function as a wedge, said upper edge also having a central cutout therein in the shape of a V-shaped notch with a minimum depth dimension of approximately one-half of an inch and a minimum width dimension of approximately one-half of an inch.

7. The apparatus of claim 6 wherein said base support has a square configuration with a side dimension between a minimum of eight inches and a maximum of ten inches.

8. The apparatus of claim 6 wherein said base support and said treatment member are made from rigid, lightweight plastic materials.

9. The apparatus of claim 8 wherein said base support and said treatment member are made as a one-piece unit from molded construction.

10. A self-treatment method of using a neck treatment apparatus of claim 1 comprising the steps of providing a neck treatment apparatus of claim 1, placing said treatment apparatus on a flat surface and positioning a patient's head against said upper edge of said treatment apparatus with said upper edge between the base of the patient's skull and the first vertebra so that said upper edge functions as a wedge to uncomfortably apply deep concentrated pressure to muscles to lengthen the muscles and as a result of such lengthening relieve pain and tension in the patient which had been caused by excess muscular contraction while said notch prevents said treatment apparatus from applying pressure directly on the spinous process of the first vertebra during initial stages of treatment when muscles are contracted and little space is available between the first vertebra and the base of the skull for insertion of said upper edge.

11. The method of claim 10 wherein said step of positioning the head of a patient against said upper edge continues for a maximum time period of approximately ten minutes.

12. The method of claim 10 wherein the step of providing the treatment apparatus of claim 1 includes providing a treatment apparatus made from rigid, lightweight plastic materials.

* * * * *